US006422671B1

(12) United States Patent
Lodge et al.

(10) Patent No.: US 6,422,671 B1
(45) Date of Patent: Jul. 23, 2002

(54) KEY CABINET WITH STAGGERED KEY PANELS

(75) Inventors: Glenn R. Lodge, O'Fallon, MO (US); C. Wayne Clyburn, Union, KY (US)

(73) Assignee: Block and Company, Inc., Wheeling, IL (US)

( * ) Notice: Subject to any disclaimer, the term of this patent is extended or adjusted under 35 U.S.C. 154(b) by 0 days.

(21) Appl. No.: 09/479,282

(22) Filed: Jan. 6, 2000

(51) Int. Cl.[7] ..... A47F 7/00
(52) U.S. Cl. ..... 312/245; 312/326
(58) Field of Search ..... 312/245, 242, 312/326, 329, 295, 234, 234.1, 234.2, 234.3, 234.5, 291, 305; 206/37.3, 37.6, 37.8, 37.1; 211/85.9, 87.01, 70.1; 40/657, 585

(56) References Cited

U.S. PATENT DOCUMENTS

| | | | | |
|---|---|---|---|---|
| 171,571 A | * | 12/1875 | Jacoby | 312/234.3 |
| 478,584 A | * | 7/1892 | Fraizer | 312/329 X |
| 549,618 A | * | 11/1895 | Waide | |
| 805,377 A | * | 11/1905 | Newman | |
| 1,006,481 A | * | 10/1911 | Johnson et al. | 312/242 X |
| 1,948,738 A | * | 2/1934 | Thayer | 312/326 X |
| 4,199,067 A | * | 4/1980 | Block | |
| 4,326,761 A | * | 4/1982 | Schwartz | 312/245 X |
| 4,334,620 A | * | 6/1982 | Block | 312/234.4 X |
| 5,411,139 A | | 5/1995 | Victory | |
| 5,690,212 A | * | 11/1997 | Huang Hsu | 312/326 X |
| 5,690,404 A | * | 11/1997 | Keller | 312/245 X |

FOREIGN PATENT DOCUMENTS

| | | | | |
|---|---|---|---|---|
| CA | 1054666 | * | 5/1979 | 312/242 |

* cited by examiner

*Primary Examiner*—Janet M. Wilkens
(74) *Attorney, Agent, or Firm*—Cook, Alex, McFarron, Manzo, Cummings & Mehler, Ltd.

(57) ABSTRACT

A key cabinet having a frame that defines an interior chamber with at least one panel attached within the interior chamber as well as a door attached to and overlying the frame. The door pivots away from the frame in an opposite direction than the panels to provide the user with simultaneously access to multiple panels as well as the door. In addition, a rail having grooves is provided that may be manufactured in a cost effective manner with a key releasably engaged with a corresponding groove.

14 Claims, 3 Drawing Sheets

KEY CABINET WITH STAGGERED KEY PANELS

BACKGROUND

1. Field of the Invention

The present invention relates to key cabinets, and more particularly to key cabinets having key panels and a door attached to a frame. More specifically, the present invention relates to key cabinets having key panels pivotally attached to a frame in a staggered orientation relative to one another along one side of the frame and a door pivotally attached to the other side of the frame.

2. Prior Art

Those skilled in the art can best appreciate that key cabinets are generally well-known. Typically, key cabinets have a frame with a door pivotally attached thereto. Often the door includes a latch, or lock, to prevent unauthorized access to the contents of the key cabinet. These cabinets often include a plurality of hooks extending from a rear surface of the key cabinet for receipt of keys thereon.

Although prior art key cabinets adequately achieve their intended purpose, various other devices have been suggested to further advance the art. For instance, it was deemed desirable to increase the storage capacity of key cabinets. One such key cabinet which was suggested to achieve this result is disclosed in U.S. Pat. No. 5,411,139 to Victory entitled "Orientable Keybox with Keypanels Vertically and Horizontally Extendable." This key cabinet provides a plurality of key panels slidably mounted therein having a plurality of hooks disposed on each key panel. To access one of the key panels, a user simply slides the desired key panel outwardly which permits access to the keys secured thereto. Even though such key cabinets have been found to have increased storage capacity, they also have several drawbacks. For instance, a user can only conveniently access one key panel at a time because when multiple key panels are simultaneously slid outwardly the key panels conceal one another and frustrate simple access to the panels. Further, the use of hooks to organize and secure keys within key cabinets often prove to be non-compact since the hooks secure keys in an approximately coplanar configuration relative to one another in a plane parallel with respect to the respective key panel.

To further advance the art, several other devices have been suggested such as the key cabinets currently manufactured by Telkee, Inc. under the trademarks REGENT and ARISTOCRAT to increase storage capacity while providing simplified access to the keys. Each of these key cabinets include a frame having a rear wall and a pair of oppositely disposed side walls. Fitted within the frame are a plurality of key panels pivotally attached adjacent one of the side walls of the frame. Each key panel has a plurality of hooks to organize and secure keys. These key cabinets also have a door pivotally attached to the frame adjacent the same side wall as the key panels.

Although these devices may advance the art, they also present several drawbacks. For instance, the key panels and door are attached to the frame adjacent one another in a book-type configuration so that pivoting the key panels away from the frame necessarily conceals the door and visa-versa. In addition, when a plurality of key panels are attached within these key cabinets, they are attached in an aligned configuration with each hinge disposed approximately the same distance from the adjacent wall such that the key panels are aligned and conceal one another, which frustrates simple access to the key panels positioned behind any of the other key panels in the key cabinet. Similarly, key cabinets of this type which utilize a plurality of hooks to organize and store keys as described above have proven to be expensive to manufacture and limited in storage capacity.

To further increase the storage capacity of key cabinets, various other devices have been suggested such as the apparatus manufactured by MMF Industries currently marketed under the trademark UNI-TAG. These key cabinets comprise a frame with a plurality of key panels. Each key panel includes a plurality of rails with each rail having a plurality of slots formed therethrough. A plurality of keys are attached to a tag having a slot which defines a tongue that is sized to be receivable within a corresponding slot of the rail. Although these devices may increase the storage capacity of key cabinets by storing keys in a parallel orientation rather than a coplanar orientation, as is the case with hooks, these rails have proved to be quite expensive to manufacture.

Therefore, there is a need in the art to have a key cabinet which enhances the ability of the user to identify and grasp the desired key. It would further be desirable to have a key cabinet that provides simultaneous access to multiple key panels. In addition, it would also be desirable to have a key cabinet which has expandable storage capacity. Finally, it would be desirable to have rails for a key cabinet that are designed to minimize overall manufacturing cost of the cabinet.

SUMMARY OF THE INVENTION

In brief summary, the preferred embodiment of the present invention overcomes and substantially alleviates many of the deficiencies found in the prior art by providing a key cabinet having a frame that defines an interior chamber with at least one key panel attached therein as well as a door attached to and overlying the frame. The frame includes a rear wall defining a surface with holes for receipt of a screw to secure the key cabinet to a wall. The rear wall is bounded by a pair of opposing side walls as well as opposing top and bottom walls which are transversely oriented relative to the side walls.

Each key panel of the present invention includes a body having a front surface and a corresponding rear surface. The body is interconnected by a hinge to a slat with holes formed therethrough. The body also includes a finger opening such that the key panels may be easily grasped and pivoted about the hinge by a user.

One novel feature of the present invention is that the key cabinet includes a securement mechanism for securing each key panel to the frame. The securement mechanism includes an angled panel attached between one of the side walls and the rear wall with holes formed therethrough which are sized and located to correspond with the holes on each key panel. As such, when the key panels are attached to the angled panel, each key panel is aligned in a staggered orientation relative to one another. Each angled panel is located adjacent one side wall, while the door is adjacent the other side wall. Therefore, once the door is pivoted open, each key panel is pivoted away from the frame in an opposite direction than the door. Unlike prior art key cabinets which provide simultaneous access to only one key panel and the door because the key panels and door are attached adjacent the same side wall, the user of the present invention has simultaneous access to the door as well as two key panels. Another advantageous feature of the present invention is that the key panels may be attached to or removed from the securement mechanism at the option of the user which allows the storage capacity of the key cabinet to be adjusted at the option of the user.

Still another unique aspect of the present invention is that the rear wall and each key panel includes at least one key rail. The key rail includes an upper portion and a lower portion with the upper portion being bent or otherwise formed into an obtuse angle relative to the lower portion. The lower portion includes dents which are welded to corresponding projections or the like extending from the rear wall to secure the key rails to the surface of the rear wall or panel, while the upper portion includes a plurality of teeth and corresponding grooves therebetween.

The key cabinet of the present invention further comprises a key tag assembly including a key tag having a body with an angled slot which defines a tongue. The key tag also has an orifice through which a clip is fitted. The clip is in turn fitted through an aperture of the key to couple the key tag to the key. Each key tag assembly is organized and secured within the frame by engaging the angled slot with one of the grooves.

In an alternative embodiment, to reduce the cost of the present invention, the securement mechanism includes holes formed through the top and bottom walls of the key cabinet. Preferably, the holes are aligned relative to one another in the respective top and bottom panels in an angled orientation between the interior of the rear wall and the periphery of the side wall. The key panel of this alternative embodiment includes a top lip and a bottom lip, each of which includes an aperture. A post having a shaft is fitted through the aperture with a head that abuts the corresponding lip. A screw is inserted through the hole to engage an opening in the post which secures each key panel to the frame. One skilled in the art can appreciate that the staggered orientation of the holes allows the key panels to be aligned in a staggered relationship. As in the previous embodiment, the screw holes are located adjacent the side wall opposite the other side wall which the door is attached adjacent to, thereby permitting simultaneous access to multiple key panels of the key cabinet by the user.

In operation, the user of the present invention simply pivots the door away from the frame in one direction and then pivots the key panels away from the frame in the opposite direction until the desired key panel is found by the user. The user may then reference the key ledger to determine which key is desired and locate the key by referencing the appropriate groove label. When the user has finished utilizing the key, he will simply replace the key in the correct groove by correlating the groove label with the corresponding key label. Once the key has been properly secured, the user would then pivot the key panel, or key panels, back into a parallel orientation in front of the rear wall. Thereafter, the user pivots the door into a parallel orientation relative to rear wall, thus concealing the key panels within the interior chamber.

One object of the present invention is to provide a key cabinet that is compact while maximizing storage capacity.

Another object of the present invention is to provide a key cabinet that enhances the ability of the user to quickly identify and grasp a desired key panel.

Still another object of the present invention is to provide a key cabinet which provides simultaneous access to multiple key panels by the user.

Still a further object of the present invention is to provide a rail that minimizes material usage and the resulting manufacturing cost of the key cabinet.

Still yet a further object of the present invention is to provide a key cabinet which provides a modular construction wherein key panels may be added or removed as required.

These and other objects of the present invention are realized in the preferred embodiment of the present invention, described by way of example and not by way of limitation, which provides for a key cabinet having key panels pivotally attached to a frame in a staggered orientation relative to one another along one side wall of the frame and a door pivotally attached to the other side wall of the frame.

Additional objects, advantages and novel features of the invention will be set forth in the description which follows, and will become apparent to those skilled in the art upon examination and the following more detailed description and drawings in which like elements of the invention are similarly numbered throughout.

DETAILED DESCRIPTION

Figure 1:
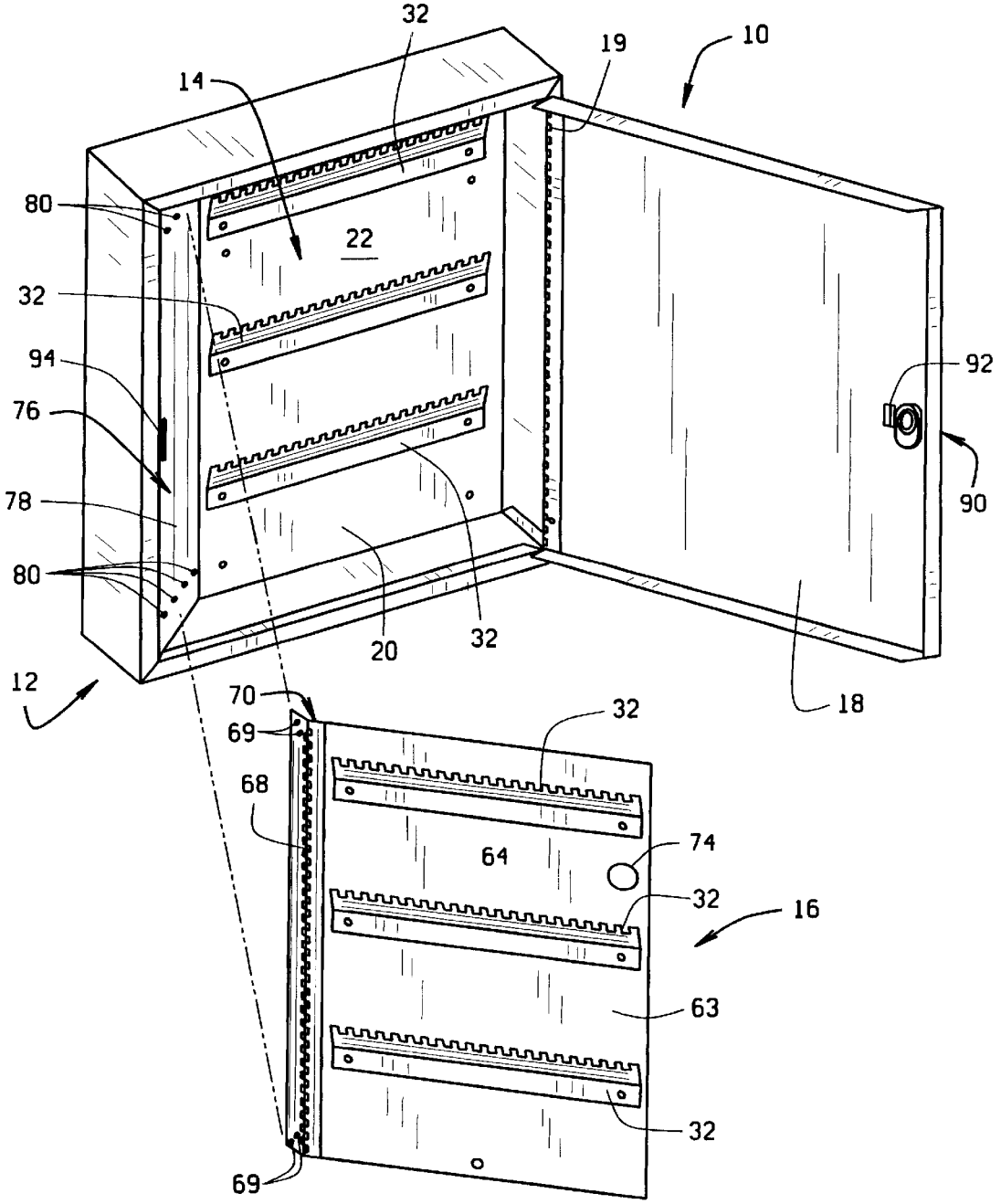
FIG. 1 is an exploded perspective view of the key cabinet according to the present invention.

Referring to the drawings, the preferred embodiment of key cabinet of the present invention is illustrated and generally indicated as 10 in FIG. 1. Key cabinet 10 includes a frame 12 defining an interior chamber 14 with at least one panel 16 attached to frame 12 within interior chamber 14 and a door 18 attached to frame 12 by a hinge 19.

Figure 2:
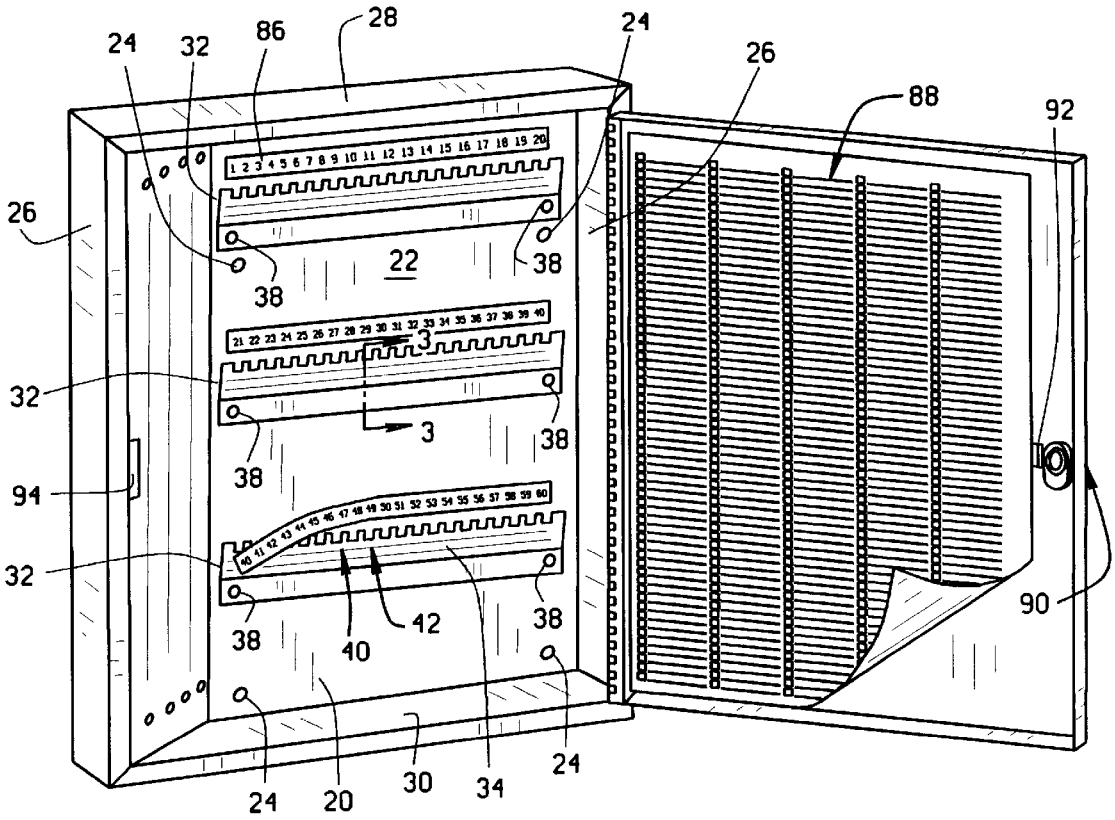
FIG. 2 is a perspective view of the key cabinet illustrating the organizational system according to the present invention.

Referring to FIG. 2, frame 12 includes a rear wall 20 defining a surface 22 having holes 24 formed therethrough for receipt of a screw (not shown) or other similar attachment device adapted to secure key cabinet 10 to a wall (not shown). Rear wall 20 is bounded by a pair of opposing side walls 26 as well as opposing top and bottom walls 28, 30 transversely oriented relative to side walls 26.

Figure 3:
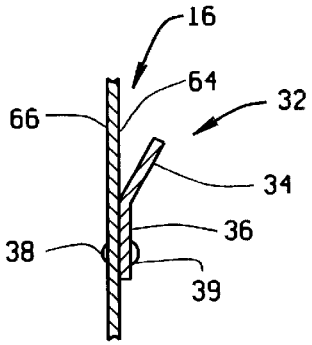
FIG. 3 is a fractional cross-sectional view of a key rail attached to a key panel taken along line 3—3 of FIG. 2 according to the present invention.

With reference to FIGS. 1 and 3, key panel 16 includes a body 63 having a front surface 64 and a corresponding rear surface 66. Key panel 16 further includes a hinge 68 attached to body 63 and a slat 70 attached to hinge 68 having holes 69 formed therethrough. Each key panel 16 further includes a finger opening 74 such that key panels 16 may be easily grasped by a user.

As further shown in FIG. 1, a novel aspect of the present invention is that key cabinet 10 includes a securement mechanism 76 for securing each key panel 16 to key cabinet 10. Preferably, this securement mechanism 76 includes an angled panel 78 with a plurality of holes 80 formed therethrough which are sized and located to correspond with the holes 69 on each slat 70. Angled panel 78 is located between one of the side walls 26 and rear wall 20 and flares outwardly from the interior of rear wall 20 towards the respective periphery of side wall 26. When key panels 16 are attached to angled panel 78, each key panel 16 is oriented in a staggered configuration relative to one another. In addition, angled panel 78 is located adjacent one side wall 26, while door 18 is hingedly attached adjacent the other side wall 26 by hinge 19. Once door 18 is pivoted open, key panel 16 may then be pivoted in an opposite direction relative to door 18 which provides the user with simultaneous access to door 18, any key panels 16 which the user has pivoted outwardly, and surface 22. Further, any key panels 16 that were not pivoted outwardly to provide the user with simultaneous access to multiple panels are also accessible to the user.

Another unique aspect of the present invention is that surface 22 and key panels 16 each include at least one key rail 32. As best appreciated with reference to FIGS. 2 and 3, key rail 32 includes an upper portion 34 and a lower portion 36 with the upper portion 34 being bent or otherwise formed into an obtuse angle relative to the lower portion 36. Lower portion 36 includes dents 39 which are welded to projections 38 to secure key rails 32 to surface 22 or to key panel 16, while upper portion 34 includes a plurality of teeth 40 and grooves 42, as shown in FIG. 2, the purpose of which will be discussed in greater detail below.

Figure 4:
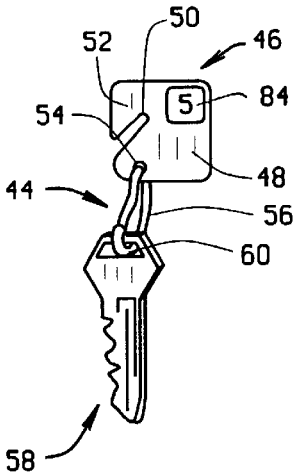
FIG. 4 is a perspective view of a key tag assembly of the key cabinet according to the present invention.

Referring to FIG. 4, key cabinet 10 further comprises a key tag assembly 44, having a key tag 46 which includes a body 48 having an angled slot 50 that defines a tongue 52. Key tag 46 further comprises an orifice 54 through which a clip 56 is inserted therethrough. Clip 56 is fitted through an aperture 60 of a key 58 for securing key 58 to key tag 46. Each key tag assembly 44 is then organized and collectively secured within the interior chamber 14 of key cabinet 10 by engaging angled slot 50 with one of the grooves 42 on any one of the key rails 32.

With reference to FIGS. 2 and 4, key cabinet 10 further comprises an organizational system which includes a distinct key label 84 on each key tag 46. The organizational system also includes a distinct key rail label 86 located adjacent each groove 42 of each rail 32 and a key ledger 88 located on door 18. Key ledger 88 permits the user to correspond each distinct key label 84 with the corresponding key rail label 86 such that the key 58 is stored in the correct groove 42. Another novel aspect of the present invention is that door 18 includes a lock 90, or other similar latching mechanism, having an arm 92 which may be releasably engaged with slot 94 formed in angled panel 78.

Figures 5, 6:
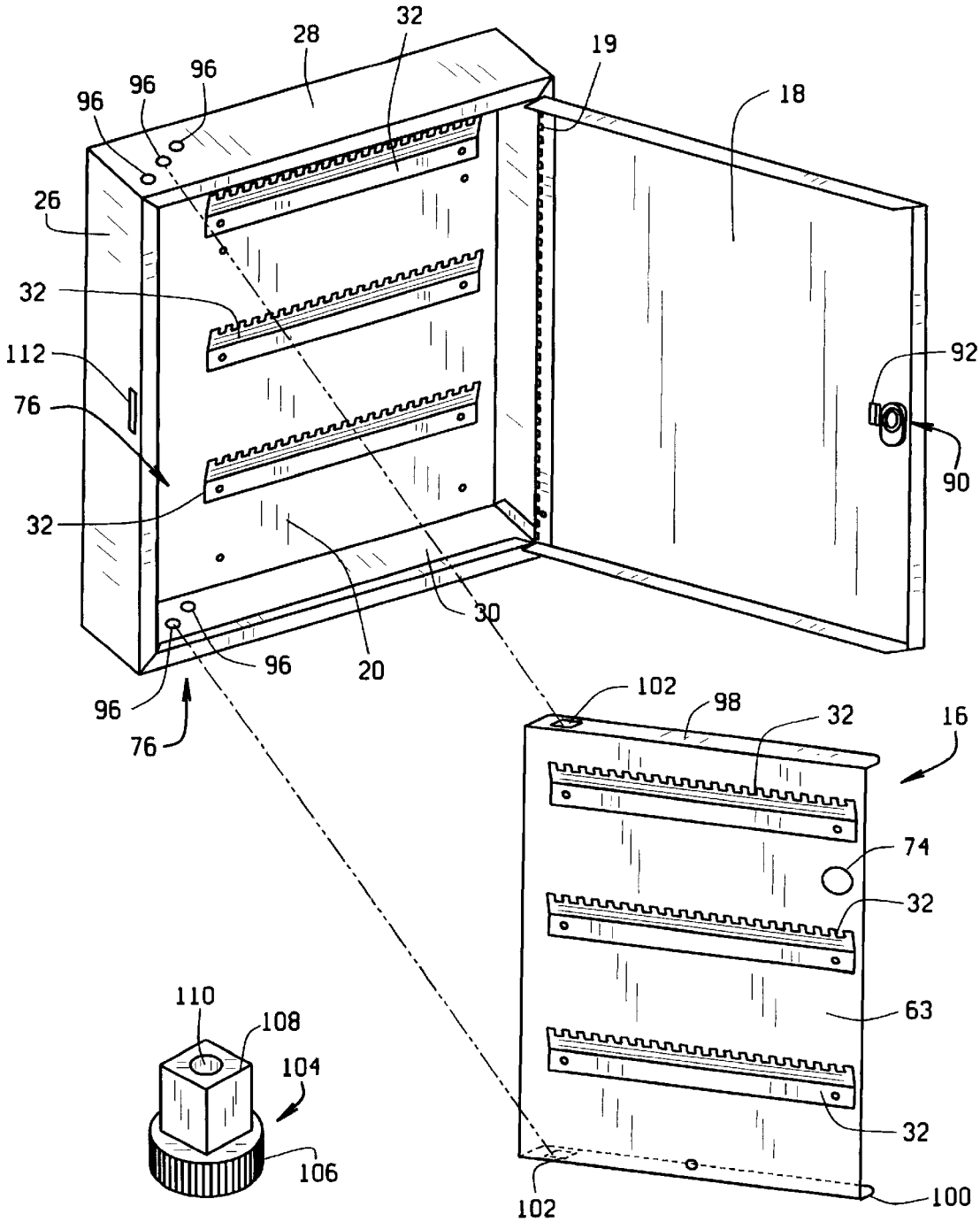
FIG. 5 is an exploded perspective view of an alternative embodiment of the key cabinet according to the present invention.
FIG. 6 is a perspective view of a post of the alternative embodiment of the key cabinet according to the present invention.

To further enhance the cost effectiveness of the present invention, an alternative embodiment of key cabinet 10 comprising a securement mechanism 76 which includes holes 96 formed through top and bottoms walls 28, 30 is shown in FIG. 5. Preferably, holes 96 are formed in the respective top and bottom walls 28, 30 in an angled orientation such that holes 96 are aligned in an outwardly flaring fashion from the interior of rear wall 20 towards the periphery of side wall 26. Key panel 16 of this alternative embodiment further includes a top lip 98 and bottom lip 100 with each respective lip 98, 100 having a square aperture 102 formed therethrough. Referring to FIG. 6, a bushing or post 104 having a head 106 and a square shaft 108 is fitted through square aperture 102 of key panel 16, while a screw (not shown) is fitted through hole 96 to engage an opening 110 in post 104 to secure each key panel 16 thereto. One skilled in the art can appreciate that the staggered arrangement of the holes 96 allows key panels 16 to be positioned in a staggered relationship. As in the other embodiment, holes 96 are oppositely located relative to the sidewall 26 of the frame 12 such that door 18 is attached adjacent thereto, thereby permitting simultaneous access to multiple key panels 16 of key cabinet 10 by the user. In this alternative embodiment, lock 90 engages slot 112 formed in side wall 26 which is oppositely located relative to side wall 26 to which door 18 is adjacent.

In operation, the user of the present invention simply pivots door 18 away from frame 12 in one direction and references key ledger 88 to determine which key 88 is presently desired. The then user pivots each key panel 16 away from frame 12 in a direction opposite to that of door 18 until the appropriate key panel 16 is identified and the desired key 58 is located by identifying the correct key rail label 86 with the corresponding key label 84. When the user has finished utilizing key 58, key 58 is then replaced in the appropriate groove 42 by correlating key rail label 86 with the corresponding key label 84. Once this is completed, the user pivots key panel 16 into a parallel orientation relative to rear wall 20, and then pivots door 18 into a parallel orientation relative to and overlying rear wall 20. Finally, the user may prevent unauthorized access to key cabinet 10 by engaging arm 92 of lock 90 with slot 94, or slot 112 as disclosed in the alternative embodiment.

It should be understood from the foregoing that while particular embodiments of the invention have been illustrated and described, various modifications can be made thereto without departing from the spirit and scope of the present invention.

What is claimed is:

1. A key cabinet comprising:

a frame defined by a rear wall and a pair of opposed side walls, said frame being further defined by a top wall oppositely disposed from a bottom wall, said top wall and said bottom wall being transversely disposed relative to said side walls;

a securement mechanism having an angled panel with holes formed therethrough, said angled panel flaring outwardly from said rear wall towards one of said side walls; and a door attached adjacent the other of said side walls, wherein said angled panel further comprises:

a hinge;

a body attached to said hinge; and a slat attached to said hinge, said slat having holes therethrough corresponding with said holes in said angled panel.

2. A key cabinet comprising:

a frame defined by a rear wall and a pair of opposed side walls, said frame being further defined by a top wall oppositely disposed from a bottom wall, said top wall and said bottom wall being transversely disposed relative to said side walls;

at least one panel disposed within said frame; and a securement mechanism having a plurality of holes formed in said top wall and said bottom wall, said securement mechanism further including a top lip extending from said panel and an oppositely disposed bottom lip extending from said panel having an aperture, said securement mechanism further including an attachment means interconnecting said panel to said frame.

3. The key cabinet according to claim 2, wherein said attachment means is a screw interconnecting said aperture in said top lip to a corresponding hole in said top wall and another screw interconnecting said aperture in said bottom lip to a corresponding hole in said bottom wall.

4. The key cabinet according to claim 3, wherein said aperture in said top lip and said aperture in said bottom lip are square in cross-section.

5. The key cabinet according to claim 4, wherein said securement mechanism further includes a post disposed within each said aperture.

6. The key cabinet according to claim 5, wherein said post comprises:

a shaft having a square cross-section, said shaft being sized and shaped to be receivable within each said aperture; and a head sized greater than said aperture.

7. A key cabinet comprising:

a frame defined by a rear wall and a pair of opposed side walls, said frame being further defined by a top wall oppositely disposed from a bottom wall, said top wall and said bottom wall being transversely disposed relative to said side walls;

an angled panel flaring outwardly from said rear wall toward one of said side walls and having holes formed therethrough, at least one panel pivotably attached to said angled panel adjacent one of said side walls; and a door pivotably attached adjacent the other of said side walls, wherein each panel of said at least one panel further comprises:

a hinge;

a body attached to said hinge; and a slat attached to said hinge, said slat having holes therethrough corresponding with said holes in said angled panel.

8. The key cabinet according to claim 7, wherein each said panel further includes at least one rail.

9. The key cabinet according to claim 8, wherein each rail of said at least one rail comprises:

a lower portion; and an upper portion having a plurality of grooves formed therein.

10. The key cabinet according to claim 9, wherein said upper portion is angularly disposed relative to said lower portion.

11. The key cabinet according to claim 10, wherein said upper portion forms an obtuse angle relative to said lower portion.

12. The key cabinet according to claim 7, wherein each panel further comprises at least one rail for securing and organizing keys, each said at least one rail comprising:

a lower portion; and an upper portion having a plurality of grooves formed therein.

13. The rail according to claim 12, wherein said upper portion is angularly disposed relative to said lower portion.

14. The rail according to claim 13 wherein said upper portion forms an obtuse angle relative to said lower portion.

* * * * *